US008934212B2

(12) United States Patent
Tsuda et al.

(10) Patent No.: US 8,934,212 B2
(45) Date of Patent: Jan. 13, 2015

(54) ION GENERATING APPARATUS AND AIR CLEANER

(75) Inventors: Tsutomu Tsuda, Osaka (JP); Ichirou Yoshimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/264,434

(22) PCT Filed: Mar. 2, 2010

(86) PCT No.: PCT/JP2010/053295

§ 371 (c)(1),
(2), (4) Date: Oct. 14, 2011

(87) PCT Pub. No.: WO2010/119733

PCT Pub. Date: Oct. 21, 2010

(65) Prior Publication Data

US 2012/0026641 A1 Feb. 2, 2012

(30) Foreign Application Priority Data

Apr. 16, 2009 (JP) ..... 2009-100125

(51) Int. Cl.
*H01T 23/00* (2006.01)
*F24F 3/16* (2006.01)

(52) U.S. Cl.
CPC ..... *H01T 23/00* (2013.01); *F24F 3/1603* (2013.01); *F24F 2003/1682* (2013.01)
USPC ..... 361/231

(58) Field of Classification Search
CPC ..... H01T 23/00
USPC ..... 361/231
See application file for complete search history.

(56) References Cited

U.S. PATENT DOCUMENTS

| | | | | |
|---|---|---|---|---|
| 4,951,172 | A | 8/1990 | Steinman et al. | |
| 6,668,563 | B2 * | 12/2003 | Mirowsky et al. | 62/78 |
| 2002/0122751 | A1 | 9/2002 | Sinaiko et al. | |
| 2002/0134664 | A1 | 9/2002 | Taylor et al. | |
| 2009/0042502 | A1 * | 2/2009 | Kim et al. | 454/139 |

FOREIGN PATENT DOCUMENTS

| | | | |
|---|---|---|---|
| EP | 1 671 659 | A1 | 6/2006 |
| EP | 2 325 961 | A1 | 5/2011 |

(Continued)

OTHER PUBLICATIONS

European Search Report mailed Oct. 26, 2012 from the corresponding European patent application No. 10764319.9.

(Continued)

*Primary Examiner* — Rexford Barnie
*Assistant Examiner* — Ann Hoang
(74) *Attorney, Agent, or Firm* — Birch, Stewart, Kolasch & Birch, LLP

(57) ABSTRACT

An ion generating apparatus has: a housing having an intake port and an exhaust port; a fan having an impeller and a casing accommodating the impeller, and accommodated in the housing; a filter passing the air taken in through the intake port by the fan; and two ion generating parts generating positive ions and negative ions. The ion generating parts are arranged in an arc-shaped guide wall of the casing. The positive ions and the negative ions generated by the ion generating parts are efficiently mixed into air flowing in a state of laminar flow along the arc-shaped guide wall.

7 Claims, 5 Drawing Sheets

(56) References Cited

FOREIGN PATENT DOCUMENTS

| | | | | |
|---|---|---|---|---|
| EP | 2 413 443 | A1 | | 2/2012 |
| JP | 2-152561 | A | | 6/1990 |
| JP | 7-44079 | B2 | | 5/1995 |
| JP | 2001-110590 | A | | 4/2001 |
| JP | 2002-90058 | A | | 3/2002 |
| JP | 2002-257408 | A | | 9/2002 |
| JP | 2003-90571 | A | | 3/2003 |
| JP | 2004-329639 | A | | 11/2004 |
| JP | 2004-347264 | A | | 12/2004 |
| JP | 2005-76906 | A | | 3/2005 |
| JP | 2005-243288 | A | | 9/2005 |
| JP | 2005-328904 | A | | 12/2005 |
| JP | 2005-337610 | A | | 12/2005 |
| JP | 2006-27922 | A | | 2/2006 |
| JP | 2006-46732 | A | | 2/2006 |
| JP | 2006-198029 | A | | 8/2006 |
| JP | 3859762 | B2 | | 9/2006 |
| JP | 2007-12422 | A | | 1/2007 |
| JP | 2007-21099 | A | | 2/2007 |
| JP | 2007-29497 | A | | 2/2007 |
| JP | 2007-40648 | A | | 2/2007 |
| JP | 2007040648 | A | * | 2/2007 |
| JP | 2007-114177 | A | | 5/2007 |
| JP | 2007-157482 | A | | 6/2007 |
| JP | 2007157482 | A | * | 6/2007 |
| JP | 2007-205712 | A | | 8/2007 |
| JP | 2007-222303 | A | | 9/2007 |
| JP | 2007-258073 | A | | 10/2007 |
| JP | 2007-322090 | A | | 12/2007 |
| JP | 2008-14527 | A | | 1/2008 |
| JP | 2008-59795 | A | | 3/2008 |
| JP | 2008-123917 | A | | 5/2008 |

OTHER PUBLICATIONS

Korean Office Action mailed Apr. 29, 2013 for Korean Patent Application No. 10-2011-7027187.

U.S. Office Action mailed Apr. 25, 2013 for related U.S. Appl. No. 13/061,099, filed Feb. 25, 2011.

U.S. Office Action mailed Mar. 11, 2013 for related U.S. Appl. No. 13/061,099, filed Feb. 25, 2011.

U.S. Advisory Action mailed Jan. 8, 2014 for related U.S. Appl. No. 13/061,099.

U.S. Final Office Action mailed Oct. 28, 2013 for related U.S. Appl. No. 13/061,099.

U.S. Office Action mailed Apr. 17, 2014 for related U.S. Appl. No. 13/061,099.

U.S. Final Office Action mailed Sep. 12, 2014 for related U.S. Appl. No. 13/061,099.

* cited by examiner

●: MEASUREMENT POINT
(AT 2.5-m HEIGHT)

ION GENERATING APPARATUS AND AIR CLEANER

This application is the national phase under 35 U.S.C. §371 of PCT International Application No. PCT/JP2010/053295 which has an International filing date of Mar. 2, 2010 and designated the United States of America

BACKGROUND

1. Field of the Invention

The present invention releases to an ion generating apparatus and an air cleaner releasing ions generated by an ion generating part together with air taken in by a fan, into a room so as to clean the room air.

2. Description of the Related Art

Air in a residential room is polluted with various kinds of substances such as dust of ticks, allergy substances like pollens, floating fungi, viruses, and nasty odors. Further, in recent years, a residence is constructed at high densities, and hence pollutants are easily accumulated in a room. Thus, ventilation need be performed actively. Nevertheless, in a room in a region of heavy air pollution or alternatively in a room where a hay fever sufferer lives or works, in many cases, ventilation performed by opening the window is not allowed and hence an air cleaner is used.

An air cleaner has an intake port on the rear face and has: a fan accommodated in a housing having an exhaust port in the upper part; a filter passing the air taken in through the intake port by the fan; and an ion generating part generating ions. Then, the ions generated by the ion generating part are released into a room from the exhaust port together with the air taken in by the fan. The ions decompose pollutants in the room and hence clean the room air (see, for example, Japanese Patent Application Laid-Open No. 2002-257408 (Patent Document 1, hereinafter)).

The ion generating part has a positive electrode and a negative electrode aligned in a separated manner. Then, when a potential is provided across the positive electrode and the negative electrode, positive ions are released from the positive electrode and negative ions are released from the negative electrode. The positive ions and the negative ions having been released are mixed into the air taken in by the fan, and then released into the room through the exhaust port together with the air.

SUMMARY

In a conventional air cleaner, measurement has been performed on the amount of ions generated by the ion generating part and on the amount of ions in the room released from the exhaust port together with the air. It has been found that the amount of ions in the room is rather smaller than the amount of ions generated by the ion generating part.

The present invention has been devised in view of this situation. An object of the present invention is to provide an ion generating apparatus and an air cleaner in which an ion generating part is arranged in a laminar flow part where the conduction of air taken in by a fan is brought into a laminar flow, so that the ions generated by the ion generating part are efficiently mixed into the air taken in by the fan and hence the difference between the amount of ions generated by the ion generating part and the amount of ions in the room is reduced, that is, the amount of ions in the room is increased.

The ion generating apparatus according to the present invention is characterized by an air cleaner comprising: a housing having an intake port and an exhaust port; a fan accommodated in the housing; a filter passing the air taken in through the intake port by the fan; and an ion generating part generating ions, so that the ions generated by the ion generating part are released from the exhaust port together with the air taken in by the fan, wherein the ion generating part is arranged in a laminar flow part where the air conduction is brought into a laminar flow.

In this invention, the ions generated by the ion generating part are mixed into the air in the laminar flow part where the air conduction is brought into a laminar flow. Thus, the ions generated by the ion generating part are efficiently mixed into the air. Further, the amount of ions mixed into the air is increased, and hence the amount of ions released into the room is increased. This enhances the cleanness of the room air further.

In the ion generating apparatus according to the present invention, the fan has an impeller and has an air coordination body coordinating an air flow generated by revolution of the impeller, and the ion generating part is arranged in the air coordination body.

In this invention, the ions are efficiently mixed into the air coordinated by the air coordination body so as to be conducted in the form of a laminar flow. Thus, the amount of ions released from the exhaust port together with the air is increased further.

Further, in the ion generating apparatus according to the present invention, the air coordination body is a casing accommodating the impeller.

In this invention, the ions are mixed into the air of laminar flow conducted through a relatively narrow path in the casing. Thus, the ions generated by the ion generating part are efficiently mixed into the air, and hence the amount of ions released from the exhaust port together with the air is increased further.

In the ion generating apparatus according to the present invention, the fan has an impeller and a casing accommodating the impeller, and has a conduction path arranged between the casing and the exhaust port and conducting the air to the exhaust port, and the ion generating part is arranged in the conduction path and the casing.

In this invention, the ions are mixed into the air of laminar flow conducted through a relatively narrow path in the casing. Further, the ions generated by the ion generating part are mixed into the air blown off from the blow-off port of the casing into the conduction path. Thus, the ions generated by the ion generating part are more efficiently mixed into the air, and hence the amount of ions released from the exhaust port together with the air is increased further.

Further, in the ion generating apparatus according to the present invention, the casing has: an arc-shaped guide surface guiding the air flow generated by revolution of the impeller; and a blow-off port opened from a part of the arc-shaped guide surface toward one of tangential directions of the arc-shaped guide surface, and the ion generating part is arranged in the arc-shaped guide surface.

In this invention, the ions are mixed into the air of laminar flow conducted at high wind speeds through a relatively narrow path in the casing. Thus, the ions generated by the ion generating part are more efficiently mixed into the air, and hence the amount of ions released from the exhaust port together with the air is increased further.

Further, in the ion generating apparatus according to the present invention, a plurality of the ion generating parts are arranged in a manner of being separated in a direction crossing the direction of air conduction.

In this invention, the ions are mixed into the air of laminar flow at an increased number of sites along a relatively narrow path in the casing. Thus, the ions generated by the ion generating part are more efficiently mixed into the air, and hence the amount of ions released from the exhaust port together with the air is increased further.

Further, in the ion generating apparatus according to the present invention, a plurality of the ion generating parts are arranged at positions separated in the direction of conduction and relatively biased in a direction crossing the direction of conduction.

In this invention, the ions are mixed into the air of laminar flow at an increased number of sites along a relatively narrow path in the casing with employing an existing casing. Thus, the ions generated by the ion generating part are more efficiently mixed into the air, and hence the amount of ions released from the exhaust port together with the air is increased further.

In the ion generating apparatus according to the present invention, the individual ion generating parts are arranged such as not to overlap with each other in the direction of conduction.

In this invention, the ions generated by the individual ion generating parts are mixed into the air of laminar flow without cancelling out with each other. As such, the ions are mixed into the air more efficiently, and hence the amount of ions released from the exhaust port together with the air is increased further.

In the ion generating apparatus according to the present invention, a holding body holding the individual ion generating parts is provided, the holding body has a curved surface which is curved in the direction of conduction and in which parts corresponding to the individual ion generating parts are opened, and the individual ion generating parts are arranged in the openings of the curved surface.

In this invention, the curved surface of the holding body is in opposite contact with the arc-shaped guide plane of the casing guiding the air flow generated by the revolution of the impeller. Thus, the plurality of ion generating parts are allowed to have the same shape. This equalizes the rate of ion generation for the individual ion generating parts.

Further, the air cleaner according to the present invention is characterized by employing an ion generating apparatus described above.

In this invention, the ions generated by the ion generating part are mixed into the air in the laminar flow part where the air conduction is brought into a laminar flow. Thus, the ions generated by the ion generating part are efficiently mixed into the air. Further, the amount of ions mixed into the air is increased, and hence the amount of ions released into the room is increased. This enhances the cleanness of the room air further.

According to the present invention, the ions generated by the ion generating part are mixed into the air in the laminar flow part where the air conduction is brought into a laminar flow. Thus, the ions generated by the ion generating part are efficiently mixed into the air. Accordingly, the amount of ions mixed into the air is increased, and hence the amount of ions released into the room is increased.

DETAILED DESCRIPTION

Figure 1:
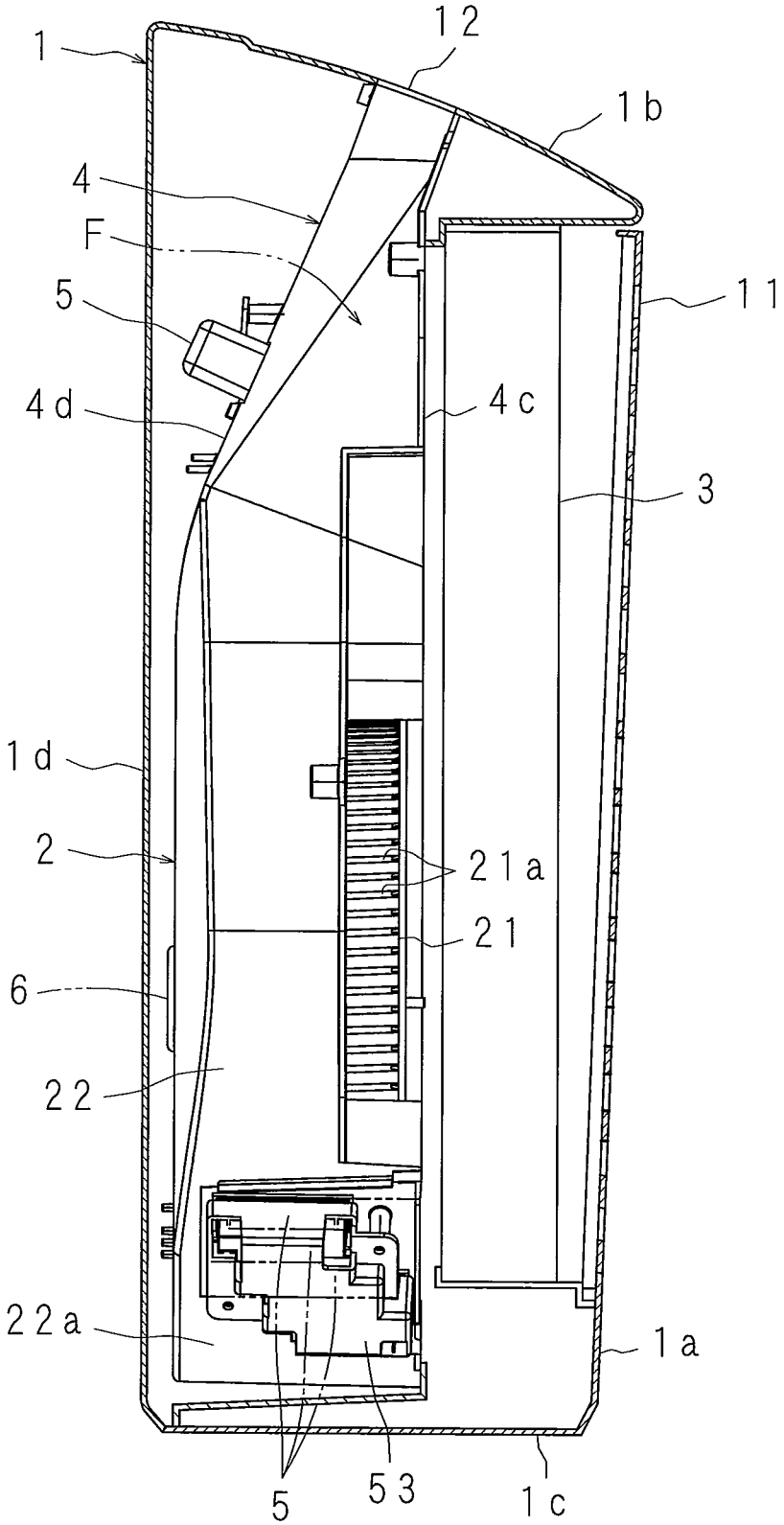
FIG. 1 is a vertical sectional side view illustrating an air cleaner.
Figure 2:
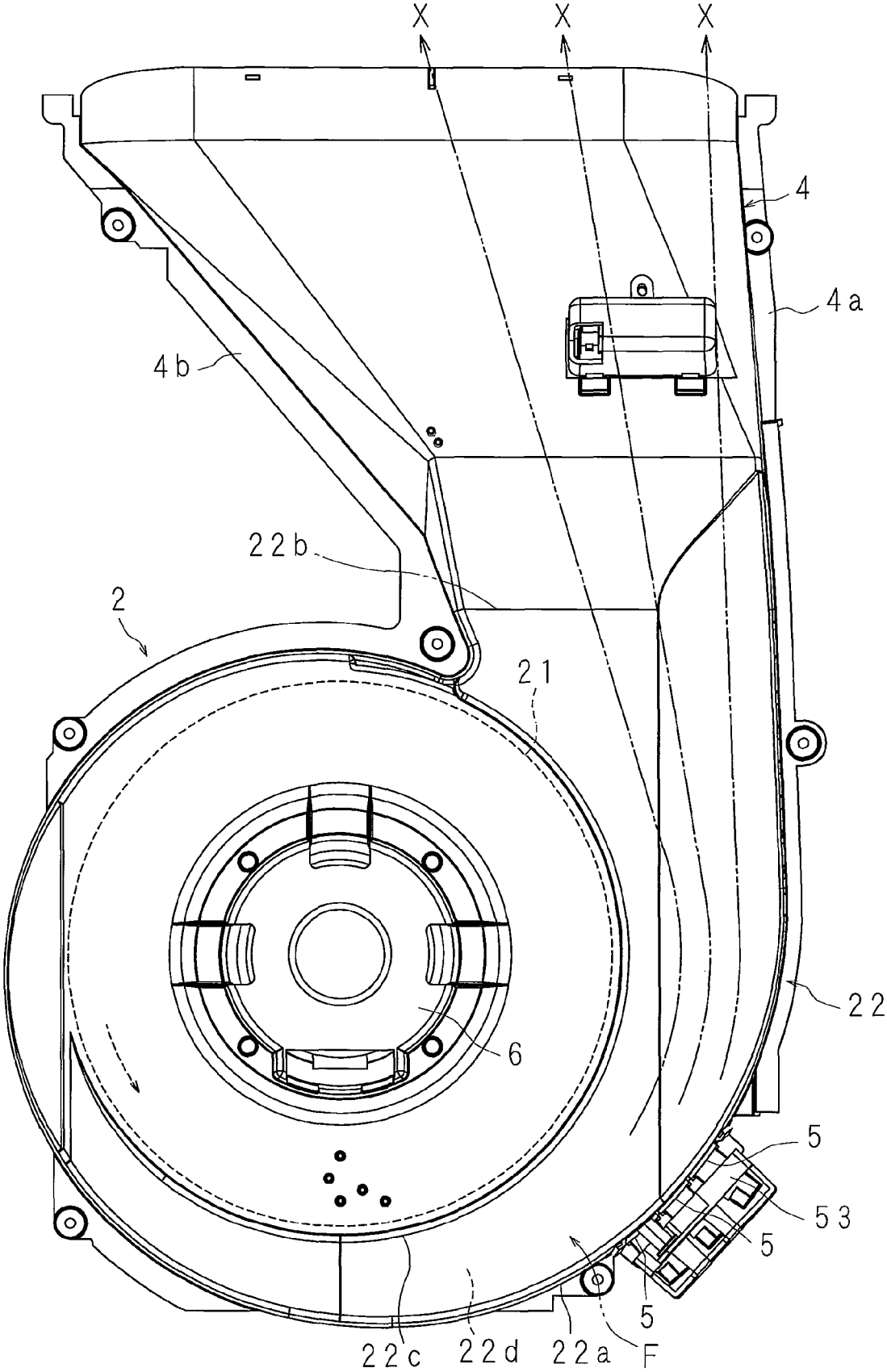
FIG. 2 is a front view illustrating a main part of an air cleaner.
Figure 3:
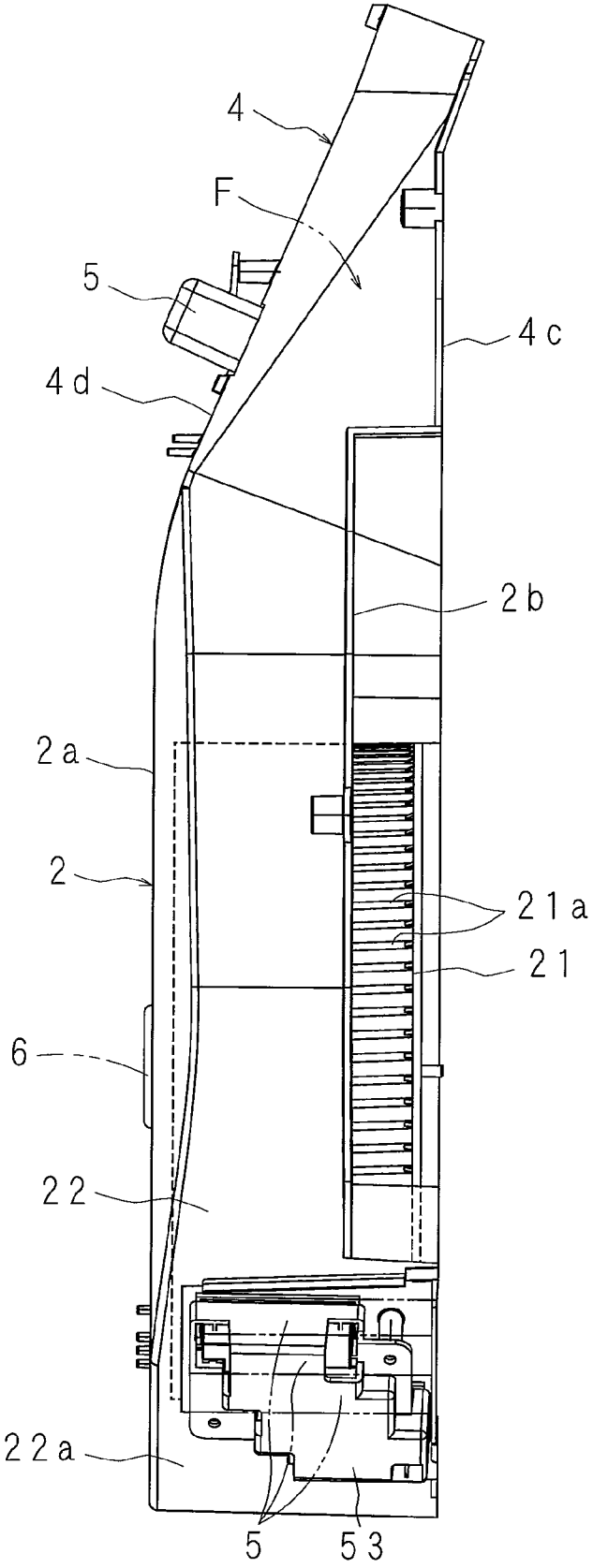
FIG. 3 is a side view illustrating a main part of an air cleaner.
Figure 4A:
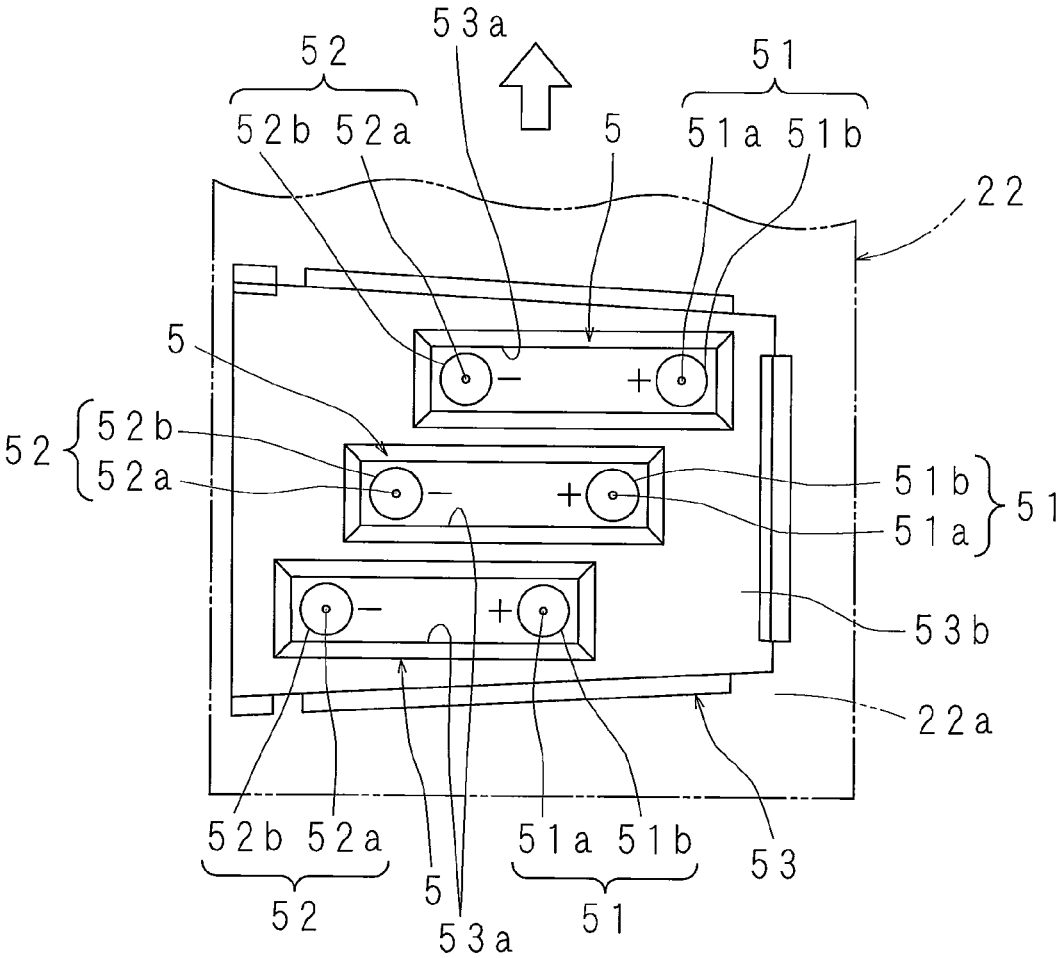
FIG. 4A is a front view of an ion generator of an air cleaner.
Figure 4B:
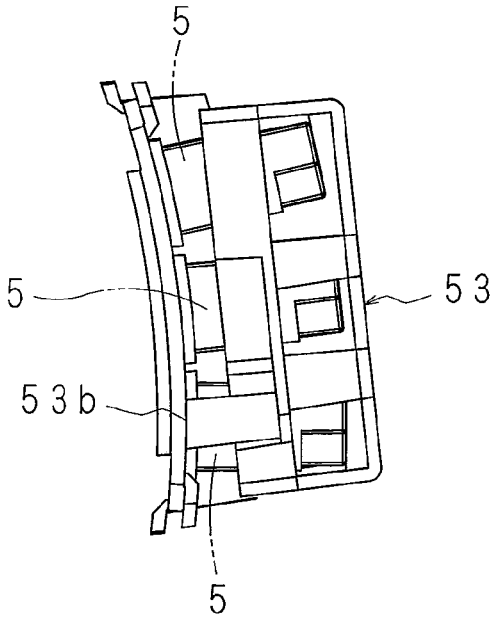
FIG. 4B is a side view of an ion generator of an air cleaner.

An embodiment is described below in detail with respect to the drawings. This description is given for an example of an air cleaner. FIG. 1 is a vertical sectional side view illustrating an air cleaner. FIG. 2 is a front view illustrating a main part. FIG. 3 is a side view illustrating a main part. FIG. 4A is a front view of an ion generator of an air cleaner. FIG. 4B is a side view of the ion generator of the air cleaner.

The air cleaner illustrated in FIG. 1 has: a housing 1 having an intake port 11 in a rear wall 1*a* and having an exhaust port 12 in a top wall 1*b*; and a fan 2 arranged in the lower part in the housing 1. The air cleaner further has: a filter 3 arranged inside the intake port 11 and passing the air taken in through the intake port 11 by the fan 2 so as to remove foreign substances in the air and obtain clean air; a duct 4 arranged between the fan 2 and the exhaust port 12 and serving as a conduction path through which the air is conducted to the exhaust port 12. The air cleaner further has an ion generator 5 having two ion generating parts 51 and 52 and mixing positive ions and negative ions into the air generated by the fan 2. This air cleaner mixes the positive ions and the negative ions generated by ion generating parts 51 and 52, into the air generated by the fan 2. The air cleaner releases the positive ions and the negative ions through the exhaust port 12 to the outside together with the air.

The housing 1 forms an approximately rectangular parallelepiped having: a bottom wall 1*c* having a rectangular shape in a plan view; a front wall 1*d* and a rear wall 1*a* continuing to two sides of the bottom wall 1*c*; side walls continuing the other two sides of the bottom wall 1*c*; and a top wall 1*b*. The rear wall 1*a* is provided with an intake port 11 having a rectangular shape whose longitudinal direction is in the up and down direction. The top wall 1*b* is provided with an exhaust port 12 having a rectangular shape whose longitudinal sides are defined by the two side walls.

The fan 2 has a cylindrical shape. The fan 2 has a centrifugal shape having: an impeller 21 arranged such that the revolving shaft is in the front and rear direction; and a casing 22 accommodating the impeller 21 in a revolvable manner. A motor 6 driving the impeller 21 is attached to a front side part of the casing 22.

The impeller 21 is a multi-blade impeller having a plurality of blades 21*a* in which the rotation center side displaces in the rotation direction relative to the rim. In other words, this is a sirocco impeller having a cylindrical shape. One end of the impeller 21 is provided with a bearing plate. The output shaft of the motor 6 is attached to the shaft hole provided in the center of the bearing plate. The air taken into the cavity of the center part from the opening at the other end of the impeller 21 is released between the blades 21*a* in the outer periphery part.

The casing 22 guides the air flow generated by the revolution of the impeller 21, to the rotation direction of the impeller 21 so as to change the air flow into a laminar flow. The casing 22 has: an arc-shaped guide wall 22*a* enhancing the velocity of the air flow; a blow-off port 22*b* opened upward from a part of the arc-shaped guide wall 22*a* toward one side of the tangential direction of the arc-shaped guide wall 22*a*; and an arc-shaped partition wall 22*c* arranged between the peripheral surface of the impeller 21 and the arc-shaped guide wall 22*a*. The blow-off port 22*b* has a rectangular pipe shape protruding from a part of the arc-shaped guide wall 22*a* to one of tangential directions of the arc-shaped guide wall 22*a*. Further, the casing 22 has a deep dish shape. The casing 22 has: a casing body 2*a* having the arc-shaped guide wall 22*a*, the arc-shaped partition wall 22*c*, and an opened part for the blow-off port 22*b*; and a cover plate 2*b* in which a part corresponding to the opening of the impeller 21 is opened and which closes the opened side of the casing body 2*a*. The cover plate 2*b* is attached to the casing body 2*a* with a plurality of male screws. Here, the arc-shaped guide wall 22*a* constitutes an air coordination body coordinating the air flow generated by the revolution of the impeller 21. Further, an arc-shaped conduction path 22*d* between the arc-shaped guide wall 22*a* and the arc-shaped partition wall 22*c* serves as a laminar flow part F.

The arc-shaped guide wall 22*a* of the casing 22 is provided with through holes corresponding to the ion generating parts 51 and 52, and mounting holes separated from the through holes. The ion generator 5 is attached with male screws screwed into the mounting holes.

The duct 4 has a rectangular pipe shape whose lower end continues to the blow-off port 22*b* and whose upper end is opened, and is integrated with the casing body 2*a* and the cover plate 2*b*. Further, the duct 4 has: one side wall 4*a* arranged from the blow-off port 22*b* along one of tangential directions of the arc-shaped guide plane 22*a*; other side wall 4*b* whose separation distance from the one side wall gradually increases starting from the blow-off port 22*b*; a rear wall 4*c* continuing to the one side wall 4*a* and the other side wall 4*b* and arranged vertically; and a front wall 4*d* whose separation distance from the rear wall 4*c* gradually decreases starting from the blow-off port 22*b*. In the duct 4, a side of the front wall 4*d* facing the impeller 21 forms the laminar flow part F, and hence guides the air blown off from the blow-off port 22*b*, into a laminar flow along the one side wall 4*a*, the rear wall 4*c*, and the front wall 4*d*. Further, the front wall 4*d* is provided with through holes corresponding to the ion generating parts 51 and 52, and mounting holes separated from the through holes. The ion generator 5 is inserted into the through hole of the front wall with facing the laminar flow part F, and fixed with male screws inserted into the mounting holes.

The ion generator 5 has: two ion generating parts 51 and 52 separated in a direction crossing the direction of conduction of the air generated by the fan 2; a power feed part supplying a voltage to the ion generating parts 51 and 52; and a holding body 53 holding the ion generating parts 51 and 52 and the power feed part. In the ion generator 5, the power feed part supplies a voltage to the ion generating parts 51 and 52 so that the ion generating parts 51 and 52 perform corona discharge, and hence ions are generated.

The ion generating parts 51 and 52 have: discharge electrode protrusions 51*a* and 52*a* having an acute shape; and dielectric electrode rings 51*b* and 52*b* surrounding the discharge electrode protrusions 51*a* and 52*a*. The discharge electrode protrusions 51*a* and 52*a* are arranged in the center parts of the dielectric electrode rings 51*b* and 52*b*, respectively. In the ion generator 5, one ion generating part 51 generates positive ions and the other ion generating part 52 generates negative ions.

The ion generator 5 is attached to the arc-shaped guide wall 22*a* constituting the air coordination body of the casing 22 and to the front wall 4*d* of the duct 4. The two ion generating parts 51 and 52 are arranged at positions crossing the direction of air conduction.

As for the ion generator 5 attached to the arc-shaped guide wall 22*a* of the casing 22, three pieces are held by a single holding body 53. The three ion generators 5 are aligned in a separated manner in the direction of conduction (the direction of the arc of the arc-shaped guide wall 22*a*), and relatively biased in a direction crossing the direction of conduction (in the shaft direction of the impeller 21). Further, the ion generating parts 51 and 52 of the three ion generators 5 are arranged such that the polarities in the direction of relative bias are the same and that no overlap occurs in the direction of conduction. The ion generating parts 51 and 52 of each ion generator 5 face the inside of the casing 22 through the through hole. Further, the attachment side of the holding body 53 to the casing 22 has a curved surface 53*b* which is curved in the direction of conduction and in which three openings 53*a* corresponding to the individual ion generating parts 51 and 52 are opened. The ion generating parts 51 and 52 are arranged in the individual openings 53*a* of the curved surface 53*b*.

The above-mentioned air cleaner is installed near a wall in a residential room in such a manner that the intake port 11 is oriented to the wall side.

The impeller 21 revolves by virtue of the driving of the fan 2. Room air is taken into the housing 1 through the intake port 11. Then, an air conduction path is generated between the intake port 11 and the exhaust port 12. Foreign substances such as dust in the intake air are removed by the filter 3 so that clean air is obtained.

The air having passed through the filter 3 is taken into the casing 22 of the fan 2. At that time, the air taken into the casing 22 forms an air flow going along the arc-shaped partition wall 22*c* of the circumference of the impeller 21, and is sent out to the arc-shaped conduction path 22*d* between the arc-shaped partition wall 22*c* and the arc-shaped guide wall 22*a*. The air flow is rectified by the arc-shaped guide wall 22*a*, and brought into a laminar flow in the laminar flow part F of the arc-shaped conduction path 22*d*.

The air conducted in the form of a laminar flow in the laminar flow part F is guided to the blow-off port 22*b* along the arc-shaped guide wall 22*a* as indicated by an arrow X of a double-dotted chain line in FIG. 2, and then blows off into the duct 4 from the blow-off port 22*b*.

The ion generating parts 51 and 52 are arranged in the arc-shaped guide wall 22*a* of the casing 22 in the fan 2. Thus, the ions generated by the ion generating parts 51 and 52 are efficiently mixed into the air conducted in the form of a laminar flow through a relatively narrow path of the laminar flow part F along the arc-shaped guide wall 22*a*. Further, the air conducted along the arc-shaped guide wall 22*a* is at high wind velocities. Thus, the ions are mixed into the air more efficiently.

Further, in the ion generator 5, the two ion generating parts 51 and 52 are arranged at positions crossing the direction of air conduction, and hence the ions are mixed into the air for the first time at a larger number of sites. Thus, the ions are mixed into the air more efficiently.

Further, in the ion generator 5, three pieces are arranged in a separated manner in the direction of conduction of the clean air. Further, the three ion generators 5 are relatively biased in a direction crossing the direction of conduction, and the ion generating parts 51 and 52 of each ion generator 5 is arranged such that no overlap occurs in the direction of conduction. By virtue of this arrangement of the ion generator 5, the ions are mixed into the air for the first time at a larger number of sites. Thus, the positive ions and the negative ions generated respectively by the ion generating parts 51 and 52 of the ion generator 5 are prevented from canceling out with each other. Thus, without the necessity of size increase in the casing 22, the ions are mixed into the air more efficiently.

The positive ions and the negative ions mixed into the air conducted in the form of a laminar flow as described above are mixed with each other when the air blows off from the blow-off port 22*b* of the casing 22 into the duct 4.

The duct 4 causes the air to be conducted in the form of a laminar flow along the one side wall 4*a*, the rear wall 4*c*, and the front wall 4*d*. The ion generating parts 51 and 52 are arranged in the front wall 4*d* for the laminar flow conduction. Thus, positive ions and negative ions generated by the ion generating parts 51 and 52 arranged in the duct 4 are mixed further into the air into which the positive ions and the negative ions have already been mixed in the inside of the casing 22 of the fan 2. Thus, the amount of ions in the air is increased.

Figure 5:
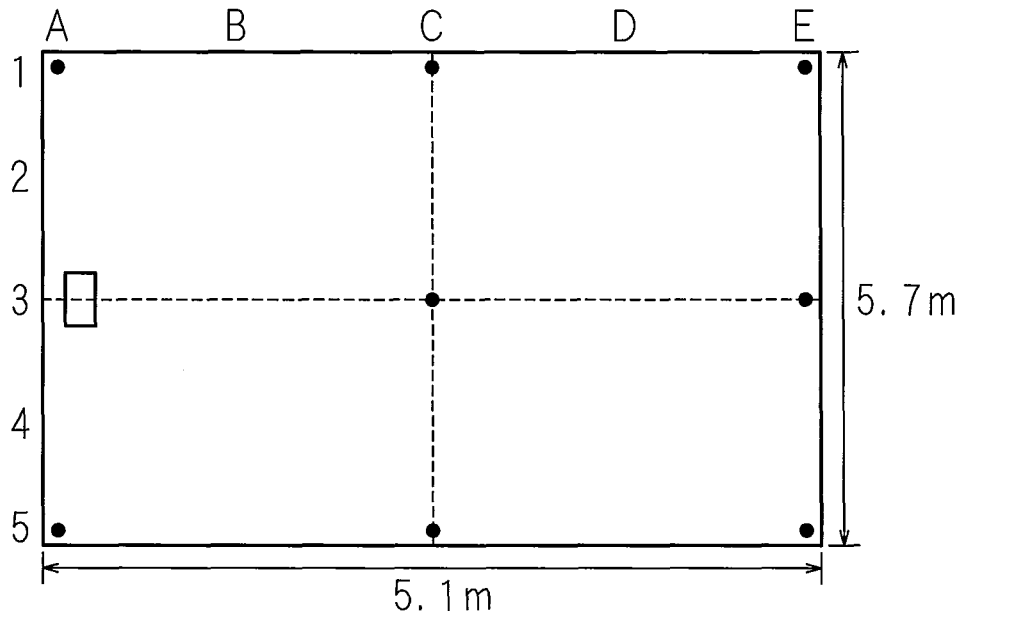
FIG. 5 is a layout of a situation that air blown off from an exhaust port of an air cleaner having been set on a room floor is measured in the room.

FIG. 5 is a layout of a situation that air blown off from an exhaust port of an air cleaner having been set on a room floor is measured in the room. Table 1 is data indicating the result of measurement of the amount of ions in the room. The amount of ions was measured at points A to E in the room for a conventional air cleaner employing an ion generator and for the air cleaner according to the present embodiment. The result indicated in Table 1 was obtained. In FIG. 5, the room has a floor area of 5.1 m×5.7 m. The air cleaner is set on the floor at 0.3 m separated from one wall on the 5.7-m side. Further, the measurement point A corresponds to points 1, 3, and 5 on the 5.7-m side which are located at 0.1 m separated from one wall on the 5.1-m side. The measurement point C is the center on the 5.1-m side of the room, and corresponds to points 1, 3, and 5 on the 5.7-m side. Further, the measurement point E corresponds to points 1, 3, and 5 on the 5.7-m side which are located at 0.1 m separated from the other wall on the 5.1-m side. Further, the measuring time is 20 minutes after the blow off start. The amount of ions indicates the concentration of positive ions (ions/cm$^3$) and the concentration of negative ions (ions/cm$^3$) in the air.

TABLE 1

| MEASUREMENT POINT | (+) ION (IONS/cc) | (−) ION (IONS/cc) | DISINFECTION ION (IONS/cc) |
|---|---|---|---|
| A1 | 49,000 | 47,000 | 47,000 |
| A3 | 300,000 | 340,000 | 63,500 |
| A5 | 80,000 | 90,000 | 80,000 |
| C1 | 32,000 | 34,000 | 32,000 |
| C3 | 15,000 | 18,000 | 15,000 |
| C5 | 47,000 | 57,000 | 47,000 |
| E1 | 18,000 | 18,000 | 18,000 |
| E3 | 27,000 | 33,000 | 27,000 |
| E5 | 27,000 | 30,000 | 27,000 |
| MEASUREMENT POINT AVERAGE | 66,111 | 74,111 | 39,611 |
| RATE OF INCREASE % | | 154 | |

HERE, MEASUREMENT POINT A3 INDICATES THE AVERAGES OF A1 AND A5.

As seen from the measurement result in Table 1, the amount of disinfection ions of measurement point average is 39,611 (ions/cm$^3$), and the rate of increase is 154%. This has demonstrated an increase in the amount of ions released into the room.

Further, conventionally, the fact has been known that positive ions $H^+(H_2O)_m$ (m is an arbitrary integer) and negative ions $O_2^-(H_2O)_n$ (n is an arbitrary integer) are delivered into air so that floating bacteria and the like are sterilized by reactions with the ions. Nevertheless, these ions recombine and disappear with each other. Thus, even when a high concentration is realized near the electrode of the ion generating element, the concentration decreases rapidly with increasing distance of delivery. Thus, although an ion concentration of a few tens of thousands of ions/cm$^3$ is achievable in a space of small volume like in an experiment apparatus, the ion concentration has been limited to at most 2,000 to 3,000 ions/cm$^3$ in a space of large volume like an actual residential space and a workspace.

On the other hand, the present inventors have found that at laboratory levels, the ions concentration of 7,000 ions/cm$^3$ eliminates 99% of bird influenza viruses in 10 minutes and the ions concentration of 50,000 ions/cm$^3$ eliminates up to 99.9%. These elimination factors indicate that when 1,000 viruses/cm$^3$ are initially present in air, 10 viruses/cm$^3$ and 1 virus/cm$^3$ remain respectively. In other words, when the ion concentration is increased from 7,000 ions/cm$^3$ to 50,000 ions/cm$^3$, the remained viruses decrease into 1/10.

As seen from this, for the purpose of infection prevention and environmental clean-up in a residential space or a workspace where a person or the like lives, it is important that not only ions at high concentrations are delivered but also high ion concentrations are maintained in the entire space.

Here, in the embodiment described above, three ion generators 5 have been arranged in the arc-shaped guide wall 22*a* of the casing provided with the laminar flow part F where the air conduction is brought into a laminar flow, and one ion generator 5 has been arranged in the front wall 4*d* of the duct 4 provided with the laminar flow part F where the air conduction is brought into a laminar flow. Also in other configurations, it is sufficient that the ion generator 5 is arranged in the laminar flow part F where the air conduction is brought into a laminar flow. That is, the part where the ion generator 5 is to be arranged is not restricted to a particular one. For example, it is sufficient that the ion generator is arranged at least at one site selected from: a part continuing the arc-shaped guide wall 22*a* of the blow-off port 22*b*; the arc-shaped guide wall 22*a*; and the front wall 4*d* of the duct 4.

The invention claimed is:

1. An ion generating apparatus comprising:

a housing having an intake port and an exhaust port;

a fan accommodated in the housing; a filter passing the air taken in through the intake port by the fan;

a guide wall; and a plurality of ion generators generating ions, so that the ions generated by the ion generators are released from the exhaust port together with the air taken in by the fan, wherein the ion generators are arranged in a laminar flow part where the air conduction is brought into a laminar flow, the plurality of ion generators are arranged on the guide wall such that at least one ion generator is downstream from at least one other ion generator in the direction of conduction, the plurality of ion generators are arranged in a manner of being separated in a direction crossing the direction of air conduction, each of the plurality of the ion generators includes a positive ion generating part and a negative ion generating part, and the ion generating parts are arranged such that no said ion generating part in the ion generating apparatus overlaps with another of said ion generating parts in the direction of conduction.

2. The ion generating apparatus according to claim 1, wherein the fan has an impeller, wherein an air coordination body coordinating an air flow generated by revolution of the impeller is provided, and wherein the ion generators are arranged in the air coordination body.

3. The ion generating apparatus according to claim 1, wherein the fan has an impeller and a casing accommodating the impeller, wherein a conduction path arranged between the casing and the exhaust port and conducting the air to the exhaust port is provided, and wherein the ion generators are arranged in the conduction path and the casing.

4. The ion generating apparatus according to claim 3, wherein the casing has: an arc-shaped guide wall guiding the air flow generated by revolution of the impeller; and a blow-off port opened from a part of the arc-shaped guide wall toward one of tangential directions of the arc-shaped guide wall, and wherein the ion generators are arranged in the arc-shaped guide wall.

5. The ion generating apparatus according to claim 1, wherein the plurality of the ion generators are arranged at positions separated in the direction of conduction and relatively biased in a direction crossing the direction of conduction.

6. The ion generating apparatus according to claim 5, comprising a holding body holding the individual ion generating parts of the ion generator, wherein the holding body has a curved surface which is curved in the direction of conduction and in which parts corresponding to the individual ion generating parts of each ion generator are opened, and wherein the individual ion generating parts of each ion generator are arranged in the opening of the curved surface.

7. An air cleaner employing an ion generating apparatus according to claim 1.

* * * * *